US010875071B2

(12) United States Patent
Hitch

(10) Patent No.: US 10,875,071 B2
(45) Date of Patent: Dec. 29, 2020

(54) APPARATUSES AND METHODS FOR MODIFYING A DEFECT IN A SURFACE

(71) Applicant: Toyota Motor Engineering & Manufacturing North America, Inc., Erlanger, KY (US)

(72) Inventor: Jared R. Hitch, Flemingsburg, KY (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 577 days.

(21) Appl. No.: 15/624,188

(22) Filed: Jun. 15, 2017

(65) Prior Publication Data

US 2018/0361448 A1 Dec. 20, 2018

(51) Int. Cl.
*B21D 1/06* (2006.01)
*B21D 1/10* (2006.01)

(52) U.S. Cl.
CPC ..... *B21D 1/065* (2013.01); *B21D 1/10* (2013.01)

(58) Field of Classification Search
CPC . B21D 1/065; B21D 1/10; B21D 1/06; B21D 1/08
USPC ..... 72/31.02, 31.11, 705
See application file for complete search history.

(56) References Cited

U.S. PATENT DOCUMENTS 1,798,379 A * 3/1931 Kott ..... B21D 1/06 72/466
2,175,846 A 10/1939 Margolis
3,559,753 A * 2/1971 Meri ..... B25D 17/12 173/137
4,193,203 A * 3/1980 LeGrand ..... B21D 1/12 33/288
5,119,667 A 6/1992 Hollis et al.
5,122,042 A * 6/1992 Einiger ..... B29C 73/025 156/94
5,509,848 A 4/1996 Shimbara
5,837,294 A * 11/1998 Shrimpton ..... B29C 73/025 425/12
7,104,108 B2 * 9/2006 Roche ..... B21D 1/06 72/458
7,509,721 B1 * 3/2009 Liang ..... A41H 37/005 29/243.5
2005/0188742 A1 * 9/2005 Snowden ..... B21D 1/10 72/457

(Continued)

FOREIGN PATENT DOCUMENTS

EP 1063026 A1 * 12/2000 ..... B21D 1/06

*Primary Examiner* — Adam J Eiseman
*Assistant Examiner* — Mohammed S. Alawadi
(74) *Attorney, Agent, or Firm* — Dinsmore & Shohl LLP

(57) ABSTRACT

An apparatus for modifying a defect in a surface may include a hollow shaft including a first open end and a second open end opposite the first open end, a plunger slidable within the hollow shaft and extending from the first open end, a driver coupled to the second open end of the hollow shaft and extending from the second open end, and a passive resistance mechanism coupling the plunger to the hollow shaft. The passive resistance mechanism biases the plunger towards the second open end of the hollow shaft. The plunger has markings thereon that are visible when the plunger is extended from the first open end. Methods for using the apparatus to modify a defect in a surface are also described.

18 Claims, 3 Drawing Sheets

(56) References Cited

U.S. PATENT DOCUMENTS

2009/0295104 A1 12/2009 Cover
2019/0218400 A1* 7/2019 Mistry ..... C08G 18/222

* cited by examiner

APPARATUSES AND METHODS FOR MODIFYING A DEFECT IN A SURFACE

TECHNICAL FIELD

The present specification generally relates to apparatuses and methods for modifying surface defects and, more specifically, apparatuses and methods for modifying surface defects in a reproducible manner.

BACKGROUND

Conventional methods of manufacturing stamped surface panels, such as those used to form automobile bodies, may frequently result in the occurrence of defects on the surface. For example, when aluminum is used, as many as 70% or more of the panels produced in the first six months may include surface defects that must be repaired before the automobile can be sold.

Typically, these surface defects are modified by applying a force to the surface effective to reduce the size of the defect using a hammer and a stick that is put in contact with the surface. However, difficulties may arise when training a new worker just how much force needs to be applied. Additionally, because multiple panels conventionally have the same defect(s), it is desirable to be able to reproduce the application of the force in a reliable manner. Conventional methods employ learned techniques and muscle memory, which may vary over time, and may not reliably reproduce the forces desired for application to the surface.

Accordingly, a need exists for alternative apparatuses and methods for modifying surface defects in a reproducible manner.

SUMMARY

In one embodiment, an apparatus for modifying a defect in a surface may include a hollow shaft including a first open end and a second open end opposite the first open end, a plunger slidable within the hollow shaft and extending from the first open end, a driver coupled to the second open end of the hollow shaft and extending from the second open end, and a passive resistance mechanism coupling the plunger to the hollow shaft. The passive resistance mechanism biases the plunger towards the second open end of the hollow shaft. The plunger has markings thereon that are visible when the plunger is extended from the first open end.

In another embodiment, a method for modifying a defect in a surface may include contacting the surface with an apparatus that includes a hollow shaft including a first open end and a second open end opposite the first open end, a plunger slidable within the hollow shaft and extending from the first open end, a driver coupled to the second open end of the hollow shaft and extending from the second open end, and a passive resistance mechanism coupling the plunger to the hollow shaft. The passive resistance mechanism biases the plunger towards the second open end of the hollow shaft. The plunger has a plurality of markings thereon that are visible when the plunger is extended from the first open end. The method further includes withdrawing a length of the plunger from the first open end of the hollow shaft to expose a predetermined marking of the plurality of markings, thereby extending the passive resistance mechanism from an initial position to an extended position. The method also includes releasing the plunger effective to enable the passive resistance mechanism to return to the initial position from the extended position and transferring a force from the plunger through the hollow shaft to the driver.

In yet another embodiment, a method for modifying a defect in a surface may include contacting the surface with an apparatus including a hollow shaft including a first open end and a second open end opposite the first open end, a plunger having markings there on that is slidable within the hollow shaft and extending from the first open end, a driver in the form of a nylon tip coupled to the second open end of the hollow shaft and extending from the second open end, and a spring coupling the plunger to the hollow shaft. The spring biases the plunger towards the second open end of the hollow shaft. The method further includes withdrawing a length of the plunger from the first open end of the hollow shaft to expose a predetermined marking of the plurality of markings, thereby extending the spring from an initial position to an extended position. Additionally, the method includes releasing the plunger effective to enable the spring to return to the initial position from the extended position, transferring a force from the plunger through the hollow shaft to the nylon tip, and transferring the force from the nylon tip to the surface effective to modify the defect.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
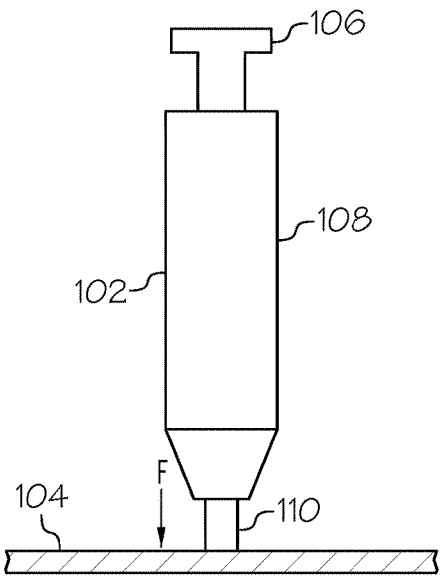
FIG. 1 depicts an example of an apparatus for use in modifying a defect on a surface according to one or more embodiments shown and described herein.

FIG. 1 generally depicts one embodiment of an apparatus for modifying a defect on a surface. The apparatus generally includes a hollow shaft having first and second open ends, a plunger slidable within the hollow shaft and extending from the first open end, and a driver coupled to the second open end of the hollow shaft and extending from the second open end. A passive resistance mechanism positioned within the hollow shaft couples the plunger to the hollow shaft and biases the plunger towards the second open end of the hollow shaft and the driver. Accordingly, when the plunger is at least partially withdrawn from the hollow shaft and released, the passive resistance mechanism returns the plunger to its original position, generating a force that is transferred from the plunger to the driver through the hollow shaft. The force is effective to modify the defect, as will be described in greater detail below. Various embodiments of the apparatus and the operation of the apparatus will be described in more detail herein.

Referring now to FIG. 1, an apparatus 102 for modifying a defect on a surface 104 is depicted. The apparatus 102 includes a plunger 106 extending from one end of a hollow shaft 108. Additionally, a driver 110 extends from a second end of the hollow shaft 108. The driver 110 is in contact with the surface 104 and transfers a force F from the apparatus 102 to the surface 104 to modify the defect on the surface. For example, the force F may be sufficient to decrease a size of the defect, or even remove the defect from the surface 104.

The hollow shaft 108 may be in the form of a hollow cylinder made from aluminum, steel, an alloy, or another type of material, including a metal, plastic, or composite material. Although a cylinder is described in various embodiments, and references made to a diameter of the shaft, it is contemplated that the hollow shaft 108 may have a cross-sectional shape other than a circle. For example, the hollow shaft 108 may have a square or rectangular cross-sectional shape, an oval cross-sectional shape, or the like. In embodiments in which the cross-sectional shape is something other than circular, the "diameter" may refer to the largest cross-sectional dimension.

In various embodiments, the hollow shaft 108 is made from a material that results in a hollow shaft 108 that is light weight, but strong enough to withstand and transfer the forces to modify the defect in the surface 104. Accordingly, in some embodiments, the hollow shaft 108 may be made from aluminum.

Figure 2:
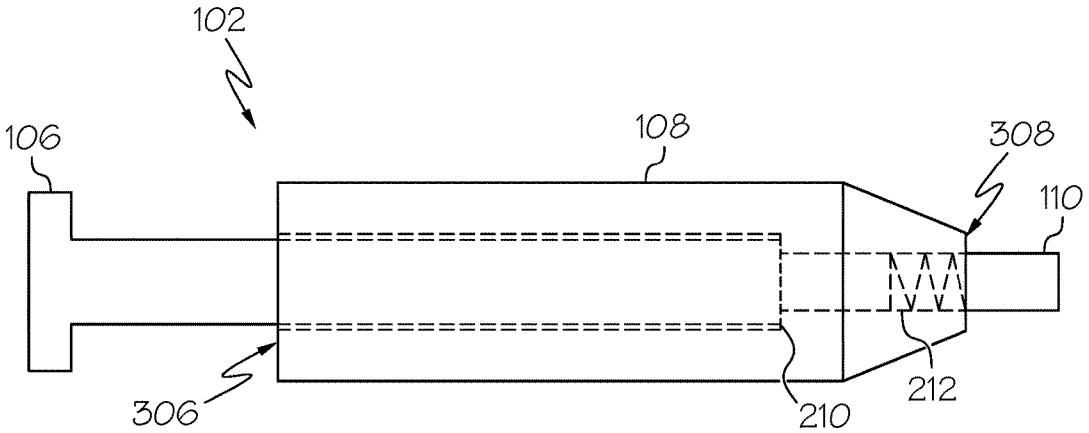
FIG. 2 depicts an example apparatus for use in modifying a defect on a surface according to one or more embodiments shown and described herein.

As shown in FIG. 2, the plunger 106 is slidable within the hollow shaft 108. In particular, the hollow shaft 108 has a first open end 306 and a second open end 308 opposite the first open end 306. The first open end 306 and the second open end 308 are separated by a length of the hollow shaft 108. The hollow shaft 108 further includes a central bore 210 (shown in phantom) sized to receive the plunger 106. Accordingly, the plunger 106 may be slidably positioned within the hollow shaft 108 and extend from the first open end 306 of the hollow shaft 108. In various embodiments, the diameter of the central bore 210 may be larger than an outer diameter of the plunger 106. In some embodiments, the plunger 106 has a diameter that is 0.25 mm, 0.50 mm, 0.75 mm, 1 mm or even 2 mm smaller than the diameter of the central bore 210. Accordingly, the plunger 106 is sized such that it is slidable within the central bore 210, although it may be in slidable contact with the central bore 210. In some embodiments, a low friction coating may be applied to the central bore 210 and/or the plunger 106, so as to reduce friction as the plunger 106 slides within the central bore 210. Alternatively, a lubricant may be applied to the plunger 106 and/or the central bore 210 to reduce the friction between the surfaces.

The hollow shaft 108 may further include internal threading 212 (shown in phantom). The internal threading 212 may be used, for example, to secure the driver 110 in place within the hollow shaft 108 with a portion of the driver 110 extending from the second open end 308 of the hollow shaft 108. In such embodiments, at least a portion of the driver 110 may include external threads that are complementary to the internal threading 212 within the hollow shaft 108. The internal threading 212 may engage the external threads on the driver 110, and a worker may rotate one of the hollow shaft 108 or the driver relative to the other such that the hollow shaft's internal threaded engagement with the driver 110 advances the driver 110 distally through the hollow shaft 108.

Although the use of threading is described to secure the driver 110 in place within the hollow shaft 108, it is contemplated that the driver 110 may be secured by other means, including but not limited to adhesives, pins, or other fastening mechanisms. In some embodiments, depending on the method of manufacturing the apparatus 102, the driver 110 may not need an additional fastening mechanism to secure the driver 110 within the hollow shaft 108. For example, the central bore 201 may be shaped to receive the driver 110 inserted from the first open end 306 and prevent the driver 110 from exiting through the second open end 308 of the hollow shaft 108, such as by a change in diameter or the like. Alternatively, the driver 110 may be affixed to the outside of the hollow shaft 108 proximate the second open end 308, such as in the form of a cap on the second open end 308. In still other embodiments, the driver may be an optional component that is not included. In such embodiments, the plunger 106 may transfer forces to the hollow shaft 108, which may transfer the forces directly to the surface 104.

The driver 110 in various embodiments may be made from a nylon material, from a metal material having a nylon coating thereon, or the like. Other materials are contemplated, provided they have the strength to transfer the force from the apparatus 102 to the surface 104 to modify the defect without introducing other defects to the surface. For example, the driver 110 should be selected from a material that does not scratch the surface 104.

The driver 110 may have a thickness of about 5 mm to about 10 mm, from about 6 mm to about 9 mm, or even about 7.5 mm, depending on the particular embodiment. In various embodiments, the driver 110 is substantially cylindrical in shape. Accordingly, in such embodiments, the thickness of the driver 110 may be a diameter of the driver 110.

Figure 3:
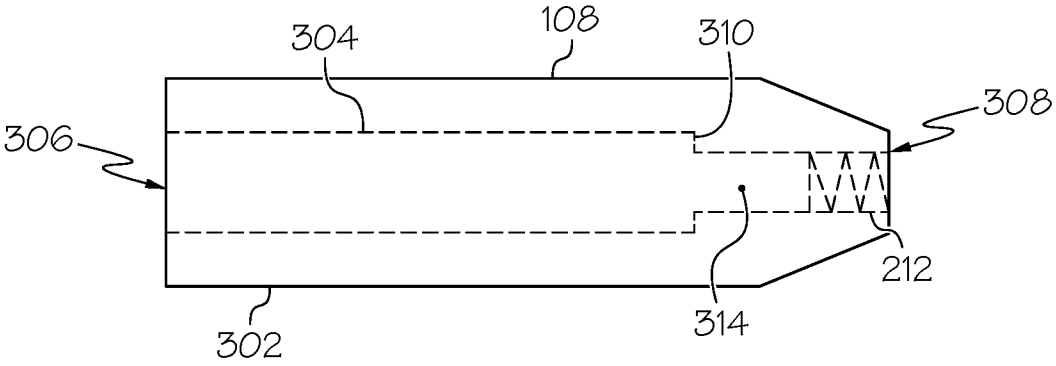
FIG. 3 depicts an example hollow shaft according to one or more embodiments shown and described herein.

The hollow shaft 108 is depicted in greater detail in FIG. 3. Specifically, the hollow shaft 108 has an external surface 302 and an internal surface 304 separated by a thickness of the hollow shaft 108. The thickness of the hollow shaft 108 may vary along the length of the hollow shaft 108. For example, the hollow shaft 108 may be tapered near the second open end 308 of the hollow shaft, as depicted in FIGS. 1-3. Additionally, the internal surface 304 may form a central bore 210 having one or more diameters. For example, the diameter of the central bore 210 proximate the first open end 306 may be larger than the diameter of the central bore 210 proximate the second open end 308. Accordingly, the hollow shaft 108 may include an internal wall 310 that is perpendicular to the length of the hollow shaft 108. The diameter of the central bore 210 may change at the internal wall 310.

The hollow shaft 108 may have an outer diameter of from about 10 mm to about 30 mm, from about 15 mm to about 25 mm, or even from about 18 to about 20 mm. In one particular embodiment, the hollow shaft 108 has an outer diameter of about 19 mm. As described above, the hollow shaft 108 may taper to a second diameter of from about 6 mm to about 28 mm, from about 10 mm to about 20 mm, or from about 12 mm to about 15 mm. The central bore 210 may have a diameter of from about 5 mm to about 20 mm, from about 10 mm to about 15 mm, or even from about 11 mm to about 13 mm. In one particular embodiment, the central bore 210 has a diameter of about 12.5 mm. In some embodiments, the diameter of the central bore 210 may change. Accordingly, a second diameter of the central bore may be from about 5 mm to about 10 mm, from about 6 mm to about 9 mm, or even about 8 mm, depending on the particular embodiment.

Additionally, the internal wall 310 may function as a stopper for the plunger 106. For example, as will be described in greater detail below, the plunger 106 may be withdrawn from the hollow shaft 108 and released, returning the plunger 106 to its original position within the hollow shaft 108. When the plunger 106 contacts the internal wall 310 of the hollow shaft 108, force is transferred from the plunger 106 to the hollow shaft 108, which transfers the force to the driver 110, which is in contact with the surface 104.

FIG. 3 further depicts a pin 314 positioned within the hollow shaft 108. The pin 314 is configured to secure a passive resistance mechanism (depicted in FIG. 5) in place within the hollow shaft 108. In various embodiments, the passive resistance mechanism couples the plunger 106 to the hollow shaft 108, as will be described in greater detail below.

Figure 5:
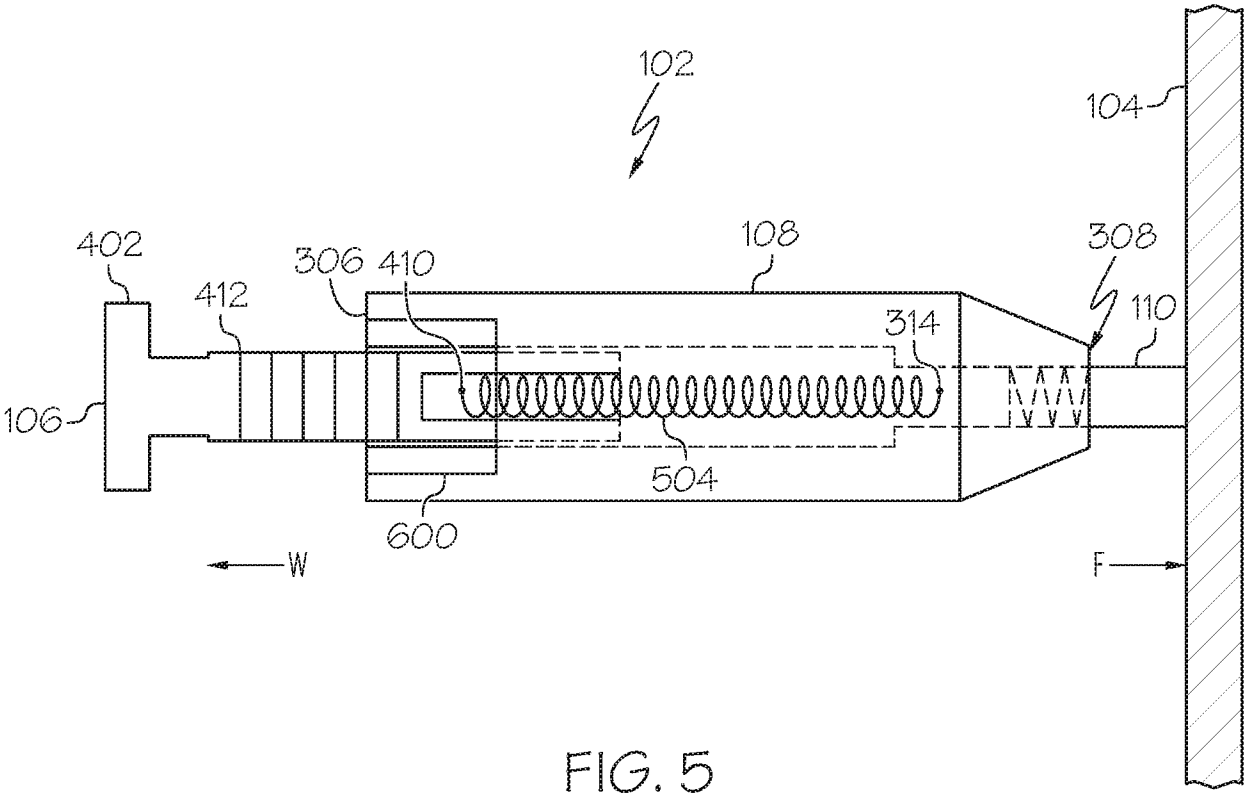
FIG. 5 depicts an example apparatus including a passive resistance mechanism located at least partially within the plunger according to one or more embodiments shown and described herein.

As depicted in FIG. 5, it is contemplated that in some embodiments, the hollow shaft 108 may further include a window 600 proximate the first open end 306 of the hollow shaft 108. The window 600 may extend through the thickness of the hollow shaft 108, and may enable a worker to observe a position of the plunger 106 within the hollow shaft 108. For example, the window 600 may have a marking thereon with which one of the markings on the plunger 106 is to be aligned as the plunger 106 is withdrawn from the hollow shaft 108 to generate a predetermined force. Accordingly, viewing the marking through the window 600 may be an alternative to viewing the marking as it is exposed outside of the hollow shaft 108, as will be described in greater detail below.

In embodiments including a window 600, it is contemplated that in some embodiments, the window 600 may include a transparent material to cover the window 600 formed in the hollow shaft 108, while in other embodiments, the window 600 may be merely a cavity in the hollow shaft 108 extending through the thickness of the wall. The transparent material may be a plastic, glass, or other material commonly used to form windows or lenses.

Figure 4:
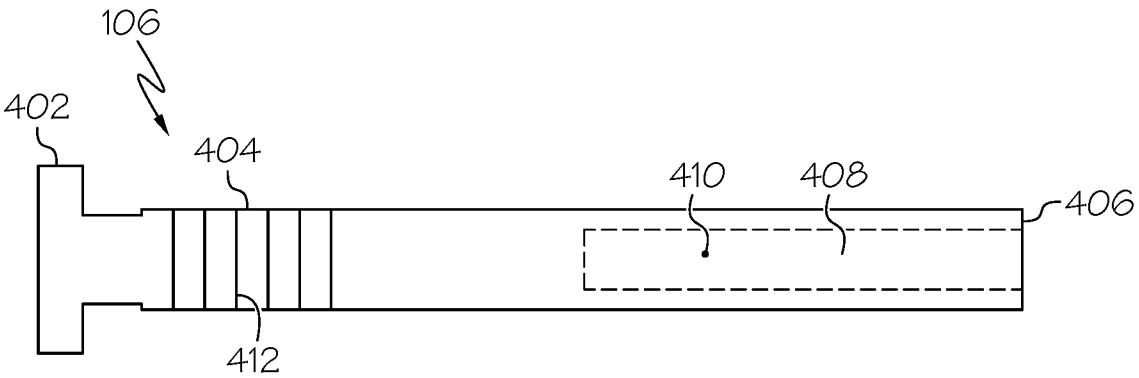
FIG. 4 depicts an example plunger according to one or more embodiments shown and described herein.

Turning now to FIG. 4, an embodiment of a plunger 106 is shown in greater detail. In particular, as shown in FIG. 4, the plunger 106 has a handle 402 at a first end 404 and a second end 406 opposite the first end 404 and separated from the first end 404 by a length of the plunger 106. Handle 402 may be shaped to enable a worker to easily grasp the plunger 106, such as to withdraw the plunger 106 from an initial position within the hollow shaft 108. As an alternative to having a handle 402 integrally formed at the first end 404 of the plunger 106, the plunger 106 may include grips or some other feature proximate the first end 404 to enable the worker to grip the plunger 106. For example, a series of raised bands or dots may form a grip for the worker.

The handle 402 may be integrally formed with the plunger 106, or the handle 402 may be separately formed and coupled wot the plunger 106 after formation. For example, the handle 402 and the plunger 106 may be formed from a single piece of material, or they may be formed from different pieces. In embodiments in which the handle is separately formed from a different piece of material, it is contemplated that the handle 402 may be formed from the same type of material, or from a different type of material, as the plunger 106.

The plunger 106 may be made of any suitable material. For example, the plunger 106 may be made from a metal, such as aluminum or steel, a plastic, such as nylon, or even a composite material. In some embodiments, the plunger 106 may be made from the same material as the hollow shaft 108, although in other embodiments, the plunger 106 may be made from a different material. In some particular embodiments, both the hollow shaft 108 and the plunger 106 may be made from an aluminum material, which may provide the strength and durability desired for the apparatus without resulting in an apparatus that is overly heavy. Accordingly, the apparatus may be of a size and weight sufficient to be carried by the worker in a pocket or the like.

In the embodiment depicted in FIG. 4, the plunger 106 includes a central bore 408 (shown in phantom) that extends from the second end 406 through a portion of the length of the plunger 106. The central bore 408 may extend from about 5% to about 75% of the length of the plunger 106. For example, the central bore 408 may extend through about 80% of the length of the plunger, through about 75% of the length of the plunger, through about 70% of the length of the plunger, through about 65% of the length of the plunger, through about 60% of the length of the plunger, through about 55% of the length of the plunger, through about 50% of the length of the plunger, through about 45% of the length of the plunger, through about 40% of the length of the plunger, through about 35% of the length of the plunger, through about 30% of the length of the plunger, through about 30% of the length of the plunger, through about 25% of the length of the plunger, through about 20% of the length of the plunger, through about 15% of the length of the plunger, through about 10% of the length of the plunger, or even through about 5% of the length of the plunger. In particular, when the central bore extends through about 30% of the length of the plunger, about 70% of the length of the plunger 106 may not include a central bore.

The length of the plunger may include the handle 402, in some embodiments. In some embodiments, the length of the plunger 106, including the handle 402, may be from about 100 mm to about 200 mm, from about 105 mm to about 180 mm, from about 110 mm to about 160 mm, from about 115 mm to about 140 mm, or from about 120 mm to about 130 mm. In some embodiments, the length of the plunger 106, not including the handle, may be from about 50 mm to about 150 mm, from about 60 mm to about 140 mm, from about 70 mm to about 130 mm, from about 80 mm to about 120 mm, or from about 90 mm to about 110 mm. In one particular embodiment, the plunger 106 has a length, including the handle 402, of about 130 mm, and a length, not including the handle 402, of about 95 mm. In this specific embodiment, the central bore extends into the length of the plunger about 53 mm from the second end of the plunger. It is contemplated that other lengths may be used, depending on the particular embodiment employed.

The plunger 106 may have a diameter that enables it to be slidable within the hollow shaft 108. For example, the plunger 106 may have a diameter of from about 5 mm to about 20 mm, from about 10 mm to about 15 mm, or even from about 11 mm to about 13 mm. In embodiments including a central bore, the central bore may have a diameter sufficient to accommodate the passive resistance mechanism. For example, the central bore may have a diameter of from about 6 mm to about 18 mm, from about 7 mm to about 10 mm, or even about 8 mm to about 9 mm. Other diameters for both the plunger 106 and the central bore are contemplated, depending on the particular embodiment employed.

In the portion of the plunger 106 including the central bore 408, the plunger 106 may have an outer surface and an inner surface separated by a thickness. In various embodiments, the thickness may be constant along the length of the central bore 408. In various embodiments, the central bore 408 is sized to accommodate the passive resistance mechanism, as will be described in greater detail below. Accordingly, in FIG. 4, a pin 410 is depicted as extending through the central bore 408. The pin 410 is configured to secure the passive resistance mechanism to the plunger 106, as will be described in greater detail below. As above, although a pin 410 is shown, it is contemplated that in some embodiments, the passive resistance mechanism may be coupled to the plunger 106 in another manner.

Additionally, it is further contemplated that in some embodiments, the plunger 106 may not include the optional central bore 408. In such embodiments, the passive resistance mechanism may be positioned within the hollow shaft 108 but not within the plunger 106. For example, the passive resistance mechanism may be secured to the second end 406 of the plunger 106 to couple the plunger 106 to the hollow shaft 108. However, without being bound by theory, it is believed that internally securing the passive resistance mechanism to the plunger 106 may result in greater consistency of the forces applied by the apparatus 102 to the surface 104.

Still referring to FIG. 4, the plunger 106 includes a plurality of markings 412 proximate the first end 404 of the plunger 106. The markings 412 may be formed along the length of the plunger 106, although in various embodiments, the markings 412 on the plunger 106 are located closer to the first end 404 of the plunger than to the second end 406 of the plunger 106. In various embodiments, each of the markings 412 has or forms a unique identifier. For example, each marking may be in the form of a number, a word, a pattern, a color, or a combination thereof. In particular embodiments, the marking may include a colored band around the circumference of the plunger 106 with a number next to it, such as to indicate a numerical order of the marking within the plurality of markings 412, a length, or the like. In other embodiments, one marking may be a plurality of dots positioned around the circumference of the plunger 106, while a second marking may be a plurality of triangles, and a third marking may be a plurality of squares positioned around the circumference of the plunger 106. In yet another embodiment, each marking may be in a difference color. Other unique identifiers may be used, depending on the particular embodiment.

Each marking may have a predetermined width. For example, the markings may have a width between about 1 mm and about 5 mm, between about 2 mm and about 4 mm, or about 3 mm. The markings may be separated from each other by a predetermined distance. In various embodiments, each marking may be separated from one another by a distance of between about 1 mm and about 10 mm, between about 2 mm and about 8 mm, between about 3 mm and about 7 mm, or between about 4 mm and about 6 mm. In one particular embodiment, each marking may be separated from one another by a distance of about 5 mm. In some embodiments, the distance between the markings may be measured from one end of a first marking to a corresponding end of the second, adjacent marking. For example, in an embodiment in which each marking has a thickness of about 3 mm, markings spaced apart by a distance of about 5 mm may have about 2 mm of unmarked space between them.

In various embodiments, each marking in the plurality of markings may have the same width, and the marking may be uniformly spaced from each adjacent marking. However, it is contemplated that the width of the markings and/or the spacing of the markings between adjacent markings may vary. For example, the plurality of markings may include markings that are thin at one end of the plurality of markings and progressively get thicker, or the markings may begin spaced farther apart and the distance between the markings may decrease.

FIG. 5 depicts an embodiment of the apparatus 102 including the details in accordance with FIGS. 2-4. Specifically, as shown in FIG. 5, the apparatus 102 includes the plunger 106 slidable within the hollow shaft 108 and extending from the first open end 306 of the hollow shaft 108. The plunger 106 includes a plurality of markings 412. The apparatus 102 further includes a driver 110 coupled to the second open end 308 of the hollow shaft 108 and extending from the second open end 308. A passive resistance mechanism 504 couples the plunger 106 to the hollow shaft 108.

As used herein, the phrase "passive resistance mechanism" refers to any resistance mechanism that resists the withdrawal of the plunger 106 from within the hollow shaft 108 without actively moving the plunger 106. For example, the passive resistance mechanism may be in the form of one or more air springs, coil springs, elastically deformable resistance bands, or the like. In particular embodiments, the passive resistance mechanism 504 is a spring. The passive resistance mechanism 504 is coupled to the plunger 106, and resists withdrawal of the plunger 106 from an initial position within the hollow shaft 108 through the first open end 306 in a direction away from the driver 110, thus providing a passive mechanical resistance to the plunger 106. The passive resistance mechanism 504 generally biases the plunger 106 towards the second open end 308 of the hollow shaft 108 and the driver 110, and resists removal of the plunger 106 from within the hollow shaft 108.

More particularly, the passive resistance mechanism 504 is coupled to the hollow shaft 108 by pin 314, which secures one end of the passive resistance mechanism 504 within the central bore of the hollow shaft 108. The passive resistance mechanism 504 is further coupled to the plunger 106 by pin 410, which secures the second end opposite the first end of the passive resistance mechanism 504 within the central bore of the plunger 106. Accordingly, in various embodiments, the passive resistance mechanism 504 is at least partially within the plunger 106 and the hollow shaft 108.

The passive resistance mechanism 504 may have a particular size and tension selected based on the particular embodiment. For example, the size of the passive resistance mechanism may be based on the diameter of the central bore 210 of the hollow shaft 108, and/or the diameter of the central bore of the plunger 106. In some embodiments, the passive resistance mechanism 504 may have a diameter from about 5 mm to about 18 mm, from about 6 mm to about 10 mm, or even about 7 mm to about 9 mm. The tension of the passive resistance mechanism 504 may vary depending on the level of repeatability and the amount of force to be generated by the apparatus. In one particular embodiment, the passive resistance mechanism 504 is in the form of a spring, such as the springs commercially available from The Hillman Group (Cincinnati, Ohio).

To use the apparatus 102 to modify a defect in a surface 104, the surface 104 is contacted with the apparatus 102. For example, if the defect is a protrusion in the surface 104, the apparatus 102 may be placed on the defect or along an edge of the defect. If the defect is a dent into the surface 104, the apparatus 102 may be placed on an opposing side of the surface 104 from the dent. One of ordinary skill in the art will appreciate that the particular placement of the apparatus 102 relative to the defect may vary depending on the particular type of defect and the material from which the surface 104 is made.

Next, a length of the plunger 106 is withdrawn from the first open end 306 of the hollow shaft 108 to expose a predetermined marking of the plurality of markings 412. For example, experience may enable a worker to determine that the plunger 106 should be withdrawn such that the fifth marking in the plurality of markings 412 is aligned with the first open end 306 of the hollow shaft 108, as shown in FIG. 5. The worker may then grip the handle 402 and pull back on the plunger 106 while maintaining the driver 110 in contact with the surface 104 effective to withdraw the length of the plunger 106 from the hollow shaft 108. It should be understood that the length of the plunger 106 that is withdrawn from the hollow shaft 108 is less than a complete length of the plunger 106. Accordingly, at least a portion of the plunger 106 remains within the hollow shaft 108 throughout the entire method. When the length of the plunger 106 is withdrawn from the first open end 306, the passive resistance mechanism 504 is extended from an initial position to an extended position. The plunger 106 may be withdrawn from the first open end 306, for example, by a user gripping the handle 402 of the plunger and applying a force W in a direction away from the surface 104.

Next, the plunger 106 is released effective to enable the passive resistance mechanism 504 to return to the initial position from the extended position. For example, the worker may release the handle, and the passive resistance mechanism 504 may return to a compressed position, pulling the plunger 106 back into the hollow shaft 108. The plunger 106 is pulled by the passive resistance mechanism at an acceleration a. Accordingly, the plunger 106 generates a force F that is equal to the mass m of the plunger 106 multiplied by the acceleration a.

When the passive resistance mechanism 504 is returned to its initial position, the plunger 106 contacts the internal wall 310 of the hollow shaft 108, and transfers the force F from the plunger 106 to the hollow shaft 108, which in turn transfers the force F to the driver 110. The driver 110 then transfers the force F to the surface 104. Although described herein as being the same force F, it should be understood that the force transferred generated by the plunger 106 accelerating through the hollow shaft 108 may vary slightly from the force applied to the surface 104 by the driver 110 as a result of the transfer of the force through the apparatus 102.

In various embodiments, the application of the force F to the surface 104 modifies the defect in the surface 104. For example, in some embodiments, the application of the force F removes the defect from the surface 104, while in other embodiments, the size of the defect is decreased. In other words, the defect may be removed from the surface 104, or it may be decreased, and may be ultimately removed by a series of forces.

Various embodiments described herein enable defects in a plurality of panels to be removed in a reproducible manner. For example, an automobile may be manufactured having a new body style, which includes contours and other features that are stamped into a metal panel. During an initial manufacturing run, a large number of panels may include the same surface defect. A skilled worker may determine the best course of modifying the defect. For example, the worker may use trial and error to determine that withdrawing the plunger to expose the fourth marking in the plurality of markings generates a force to reduce the size of the defect, and subsequently withdrawing the plunger to expose the first marking in the plurality of markings generates a force sufficient to completely remove the defect from the surface. In some embodiments, the worker may be able to select a predetermined marking on the plunger 106 to be exposed from the hollow shaft 108 based on a size of the defect in the surface 104.

The worker's process may then be documented and communicated to all of the workers on the manufacturing line, such that the same forces may be applied to the remaining panels, regardless of the worker on duty. Because each worker does not have to independently determine the appropriate amount of force needed to remove the defect, but instead may simply operate the apparatus according to the instructions from the first worker, time savings may be realized. Moreover, the method may enable an unskilled worker to assist with the work. This may be advantageous, for example, at the beginning of a new vehicle production year when there are large amounts of panels having the same defect.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An apparatus comprising:

a hollow shaft comprising a first open end and a second open end opposite the first open end;

a plunger slidable within the hollow shaft and extending from the first open end, the plunger having a plurality of markings thereon;

a driver directly coupled to the second open end of the hollow shaft and extending from the second open end; and a passive resistance mechanism directly coupling the plunger to the hollow shaft, wherein a pin secures the passive resistance mechanism within the hollow shaft, and the passive resistance mechanism biases the plunger towards the second open end of the hollow shaft; wherein:

each of the plurality of markings is indicative of a force to be transferred from the plunger through the hollow shaft to the driver when a length of the plunger is withdrawn from the first open end of the hollow shaft and released effective to enable the passive resistance mechanism to return to an initial position from an extended position.

2. The apparatus of claim 1, wherein the driver comprises a nylon tip.

3. The apparatus of claim 1, wherein the driver comprises a metal tip having a nylon coating thereon.

4. The apparatus of claim 1, wherein the passive resistance mechanism is a spring.

5. The apparatus of claim 4, wherein the plunger comprises a first end extending from the first open end of the hollow shaft, a second end positioned within the hollow shaft and separated from the first end by a length of the plunger, and a central bore extending from the second end through a portion of the length of the plunger, and wherein the spring is secured to the plunger at a location within the central bore at a first end of the spring and secured to the hollow shaft at a second end of the spring.

6. The apparatus of claim 5, wherein the markings on the plunger are located closer to the first end of the plunger than to the second end of the plunger.

7. The apparatus of claim 6, wherein each marking in the plurality of markings has a unique identifier.

8. The apparatus of claim 7, wherein the unique identifier comprises a number, a word, a pattern, a color, or combinations thereof.

9. The apparatus of claim 6, wherein the markings are visible on the plunger when the plunger is withdrawn from the hollow shaft.

10. The apparatus of claim 6, wherein the hollow shaft further comprises a window extending through a wall of the hollow shaft proximate the first open end of the hollow shaft to enable at least one of the markings on the plunger to be visible.

11. A method of modifying a defect in a surface, comprising:

contacting the surface with an apparatus comprising:

a hollow shaft comprising a first open end and a second open end opposite the first open end;

a plunger slidable within the hollow shaft and extending from the first open end, the plunger having a plurality of markings thereon;

a driver directly coupled to the second open end of the hollow shaft and extending from the second open end; and a passive resistance mechanism directly coupling the plunger to the hollow shaft, wherein a pin secures the passive resistance mechanism within the hollow shaft, and the passive resistance mechanism biases the plunger towards the second open end of the hollow shaft;

withdrawing a length of the plunger from the first open end of the hollow shaft to expose a predetermined marking of the plurality of markings, thereby extending the passive resistance mechanism from an initial position to an extended position;

releasing the plunger effective to enable the passive resistance mechanism to return to the initial position from the extended position;

transferring a force from the plunger through the hollow shaft to the driver, wherein the predetermined marking is indicative of the force; and transferring the force from the driver to the surface, thereby decreasing a size of the defect in the surface.

12. The method of claim 11, further comprising:

selecting the predetermined marking of the plurality of markings based on an initial size of the defect.

13. The method of claim 1, wherein decreasing the size of the defect comprises removing the defect from the surface.

14. The method of claim 11, wherein each marking in the plurality of markings has a unique identifier.

15. The method of claim 11, wherein the driver comprises a nylon tip.

16. The method of claim 11, wherein the driver comprises a metal tip having a nylon coating thereon.

17. The method of claim 11, wherein the plunger comprises a first end extending from the first open end of the hollow shaft, a second end positioned within the hollow shaft and separated from the first end by a length of the plunger, and a central bore extending from the second end through a portion of the length of the plunger, and wherein the passive resistance mechanism is secured to the plunger at a location within the central bore at a first end of the passive resistance mechanism and secured to the hollow shaft at a second end of the passive resistance mechanism.

18. A method for modifying a defect in a surface, comprising:

contacting the surface with an apparatus comprising:

a hollow shaft comprising a first open end and a second open end opposite the first open end;

a plunger slidable within the hollow shaft and extending from the first open end, the plunger having a plurality of markings thereon;

a driver in the form of a nylon tip directly coupled to the second open end of the hollow shaft and extending from the second open end; and a spring directly coupling the plunger to the hollow shaft, wherein a pin secures the spring within the hollow shaft, and spring biases the plunger towards the second open end of the hollow shaft;

withdrawing a length of the plunger from the first open end of the hollow shaft to expose a predetermined marking of the plurality of markings, thereby extending the spring from an initial position to an extended position;

releasing the plunger effective to enable the spring to return to the initial position from the extended position;

transferring a force from the plunger through the hollow shaft to the nylon tip; and transferring the force from the nylon tip to the surface effective to decrease a size of the defect, wherein the predetermined marking is indicative of the force.

* * * * *